US006679572B2

(12) United States Patent
Sears

(10) Patent No.: US 6,679,572 B2
(45) Date of Patent: Jan. 20, 2004

(54) LID OR DOOR FOR HOUSEHOLD APPLIANCES

(75) Inventor: Jeffrey L. Sears, Grinnell, IA (US)

(73) Assignee: Maytag Corporation, Newton, IA (US)

( * ) Notice: Subject to any disclaimer, the term of this patent is extended or adjusted under 35 U.S.C. 154(b) by 108 days.

(21) Appl. No.: 09/783,680

(22) Filed: Feb. 14, 2001

(65) Prior Publication Data

US 2002/0109445 A1 Aug. 15, 2002

(51) Int. Cl.[7] ..... A47B 88/00
(52) U.S. Cl. ..... 312/319.2; 49/326
(58) Field of Search ..... 312/405, 215, 312/326, 319.1, 319.2, 319.6, 257.1, 8.4, 8.9, 8.13, 9.11, 9.16, 9.28, 9.19, 9.63, 9.64, 35, 204, 222, 284, 223.1; 49/326, 327, 328, 329

(56) References Cited

U.S. PATENT DOCUMENTS

| | | | | | |
|---|---|---|---|---|---|
| 2,618,282 | A | | 11/1952 | Stanitz et al. | |
| 2,910,290 | A | | 10/1959 | Buchanan | |
| 3,698,781 | A | * | 10/1972 | Dunn | 312/326 X |
| 3,851,907 | A | | 12/1974 | Sandor | |
| 3,862,773 | A | | 1/1975 | Bisbing | |
| 3,921,252 | A | * | 11/1975 | Guth | 49/276 X |
| 3,991,520 | A | | 11/1976 | Graham | |
| 4,932,707 | A | | 6/1990 | Ekstran | |
| 5,004,276 | A | | 4/1991 | Hanley | |
| 5,072,974 | A | | 12/1991 | Henne | |
| 5,622,414 | A | * | 4/1997 | Artwohl et al. | 312/319.2 X |
| 5,639,149 | A | * | 6/1997 | Grassmuck | 312/319.2 X |
| 5,742,964 | A | | 4/1998 | Choi | |
| 5,882,099 | A | * | 3/1999 | Salice | 312/319.2 X |
| 5,904,411 | A | * | 5/1999 | Hayakawa | 312/319.2 |
| 5,980,006 | A | | 11/1999 | Wilhelmstatter et al. | |

* cited by examiner

*Primary Examiner*—Thomas A. Dixon
*Assistant Examiner*—Michael J. Fisher
(74) *Attorney, Agent, or Firm*—McKee, Voorhees & Sease, P.L.C.

(57) ABSTRACT

An improved appliance is provided for easy and controlled movement of the door from a closed position to an open position. The appliance includes a door pivotally mounted over an access opening. A gas-charged cylinder or strut is mounted within the appliance and connected to one end of a lever arm, with the other end of the lever arm being connected to the door. A push-push latch normally retains the door in a closed position. A person can easily push on the door to release the latch, after which the cylinder arm is automatically extended to move the door to the open position. The door, cylinder and latch combination of the present invention can be used on top-loading and front-loading appliances and appliances with doors pivotal about horizontal and vertical axes.

9 Claims, 3 Drawing Sheets

LID OR DOOR FOR HOUSEHOLD APPLIANCES

BACKGROUND OF THE INVENTION

Household appliances such as a top-loading washing machine include a lid or door pivotal about a horizontal axis for manual movement between open and closed positions relative to the access opening of the machine. With conventional top-loading machines, there is a potential that the lid or door can accidentally drop from the open position, thereby risking injury to a person who is reaching into the machine.

Other appliances, such as ovens and dishwashers, are front-loading, with a door pivotally mounted for manual movement about a horizontal axis between open and closed positions. In these front-loading appliances, unless the door is latched in the closed position, if the person lets go of the door, the door will fall open in an uncontrolled manner. Such falling of the door to the open position risks injury to a person's leg and puts excess strain on the mounting hardware of the door.

Other appliances, such as a refrigerator, which have a door mounted for pivotal movement about a vertical axis, require that the door be manually pulled open. Such pulling of the door may be difficult for person who has both hands full. Also, it is not unusual for the refrigerator door to be swung toward the closed position, yet remain slightly and unknowingly ajar.

Therefore, a primary objective of the present invention is the provision of an improved appliance having a lid or door which overcomes the problems associated with prior art lids and doors.

Another objective of the present invention is the provision of an improved appliance having a door which will automatically move to the open position in a controlled manner when the door latch is released.

A further objective of the present invention is the provision of an appliance having a gas-discharge strut to control the opening of the appliance door.

A further objective of the present invention is the provision of an improved appliance having a door with a push-push latch which is pushed to close the door and pushed to open the door.

Another objective of the present invention is the provision of an appliance having an improved door construction which is economically manufactured and durable in use.

These and other objectives will become apparent from the following description of the invention.

SUMMARY OF THE INVENTION

The present invention is directed towards the door of an appliance having either a top-opening or a front-opening for access to the chamber or compartment within the cabinet of the appliance. The appliance door may be pivotal about either a horizontal or vertical axis for movement between open and closed positions. The appliance includes a gas-discharge cylinder mounted within the cabinet and having an arm which can be extended or retracted. A bent lever arm is connected to the cylinder arm and to the door. When the cylinder is actuated to extend the arm thereof, the lever arm pivots the door to the open position. The door can be pushed to a closed position, thereby retracting the cylinder arm. The appliance includes a push-push latch for the door, such that the door is pushed to latch the door in the closed position and pushed to release the latch for movement of the door by the cylinder to the open position. If the door does not fully close, the cylinder will automatically re-open the door so that a person can see that the door did not latch in the closed position.

DETAILED DESCRIPTION OF THE DRAWINGS

Figure 1:
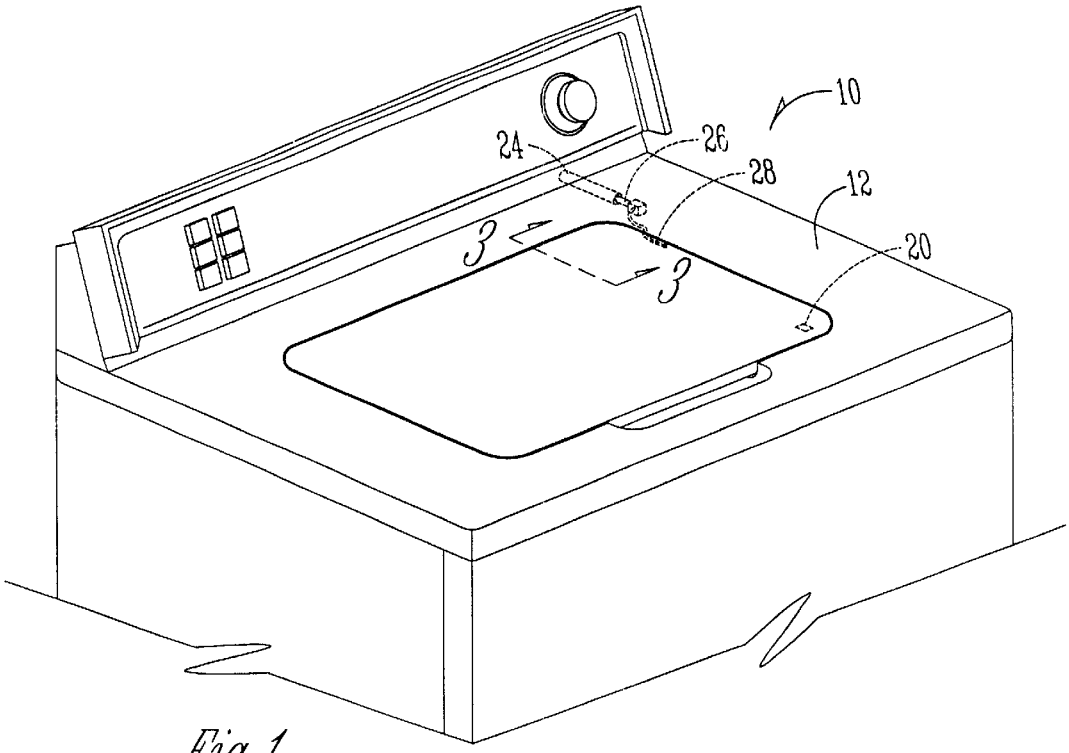
FIG. 1 is a perspective view of the improved appliance of the present invention with the door in a closed position.

An appliance, such as top-loading washing machine, as generally designated in the drawings by the reference numeral 10. The washing machine 10 includes a cabinet 12, an access opening 14 to the interior chamber 16, and a door 18 pivotally hinged to the cabinet for movement between the closed position shown in FIG. 1 and the open position shown in FIG. 2.

The appliance 10 includes a push-push latch 20 for retaining the door 18 in the closed position. More particularly, the latch 20 includes a male stud 21 on the door and a female receptacle 22 on the cabinet. When the door 18 is pushed into the closed position, the stud 21 is retentively engaged in the receptacle 22 to retain the door in the closed position. A magnetic push-push latch may also be used.

Figure 2:
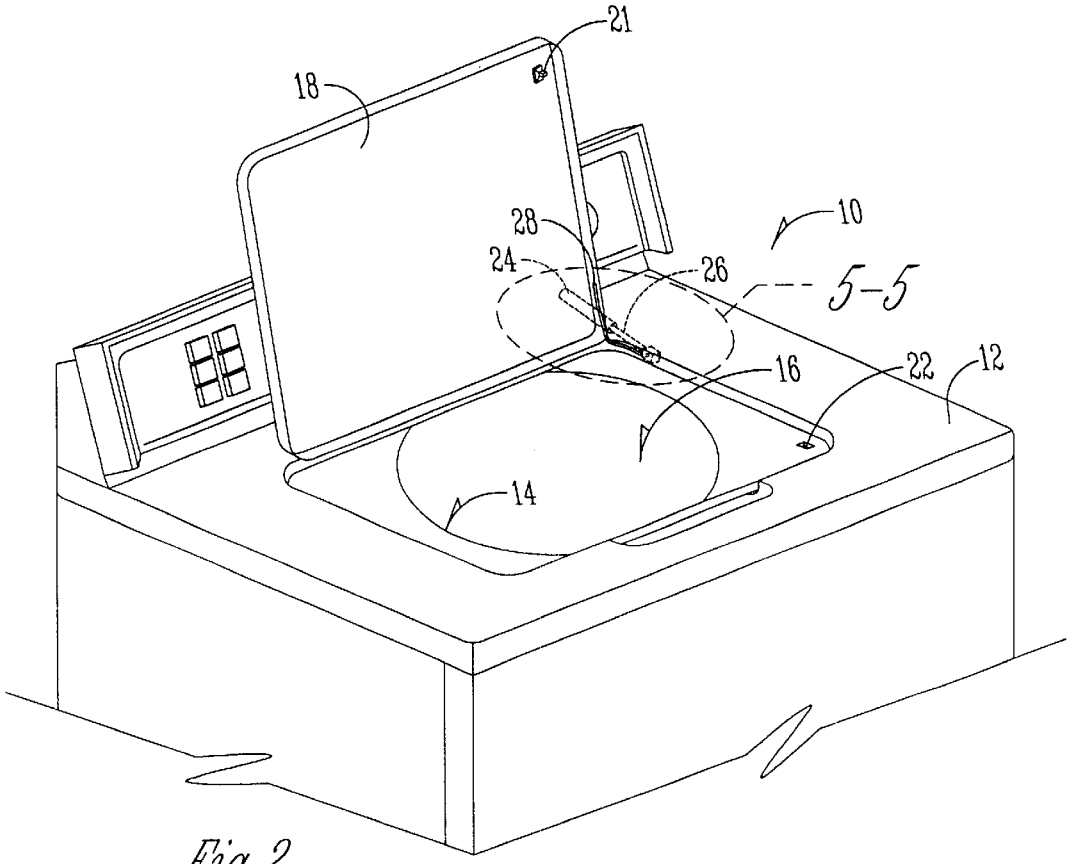
FIG. 2 is a perspective view of the improved appliance of the present invention with the door in an open position.
Figure 3:
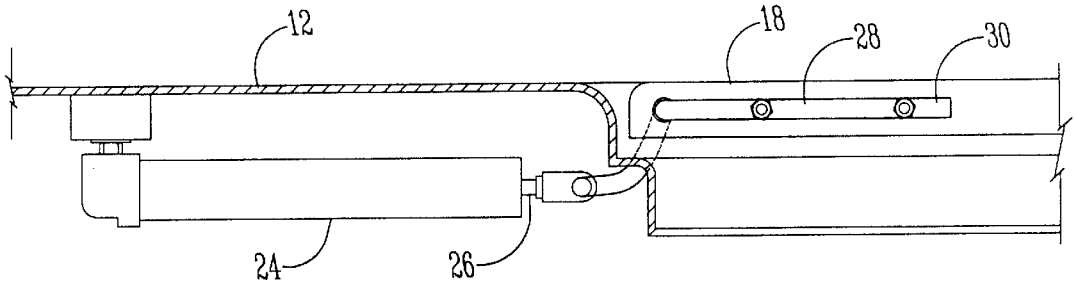
FIG. 3 is a partial sectional view taken along lines 3—3 of FIG. 1, with the door being in a closed position.
Figure 4:
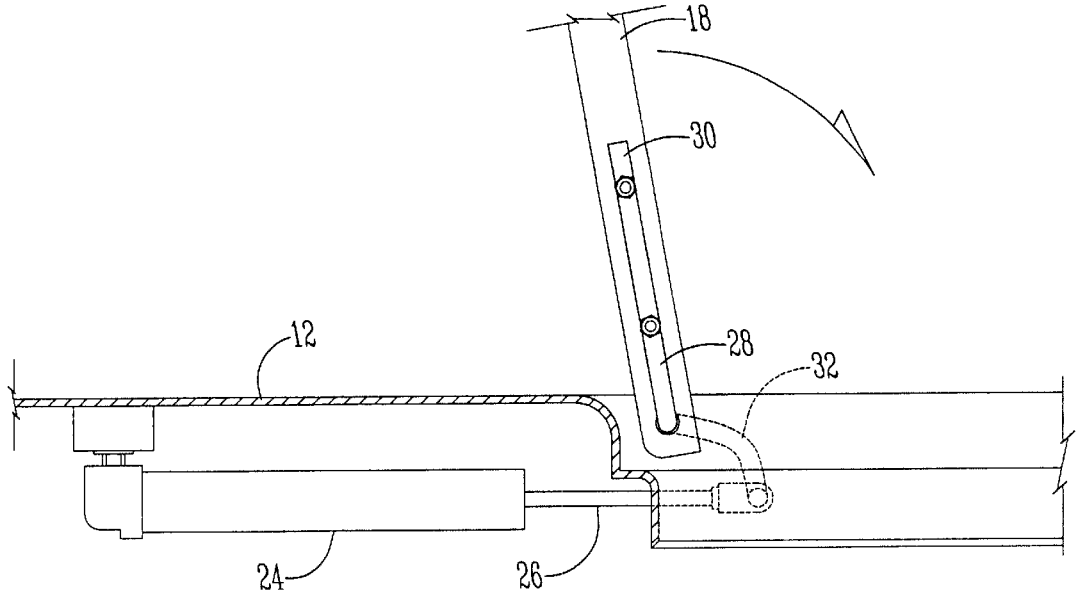
FIG. 4 is a view similar to FIG. 3 showing the door in an open position.
Figure 5:
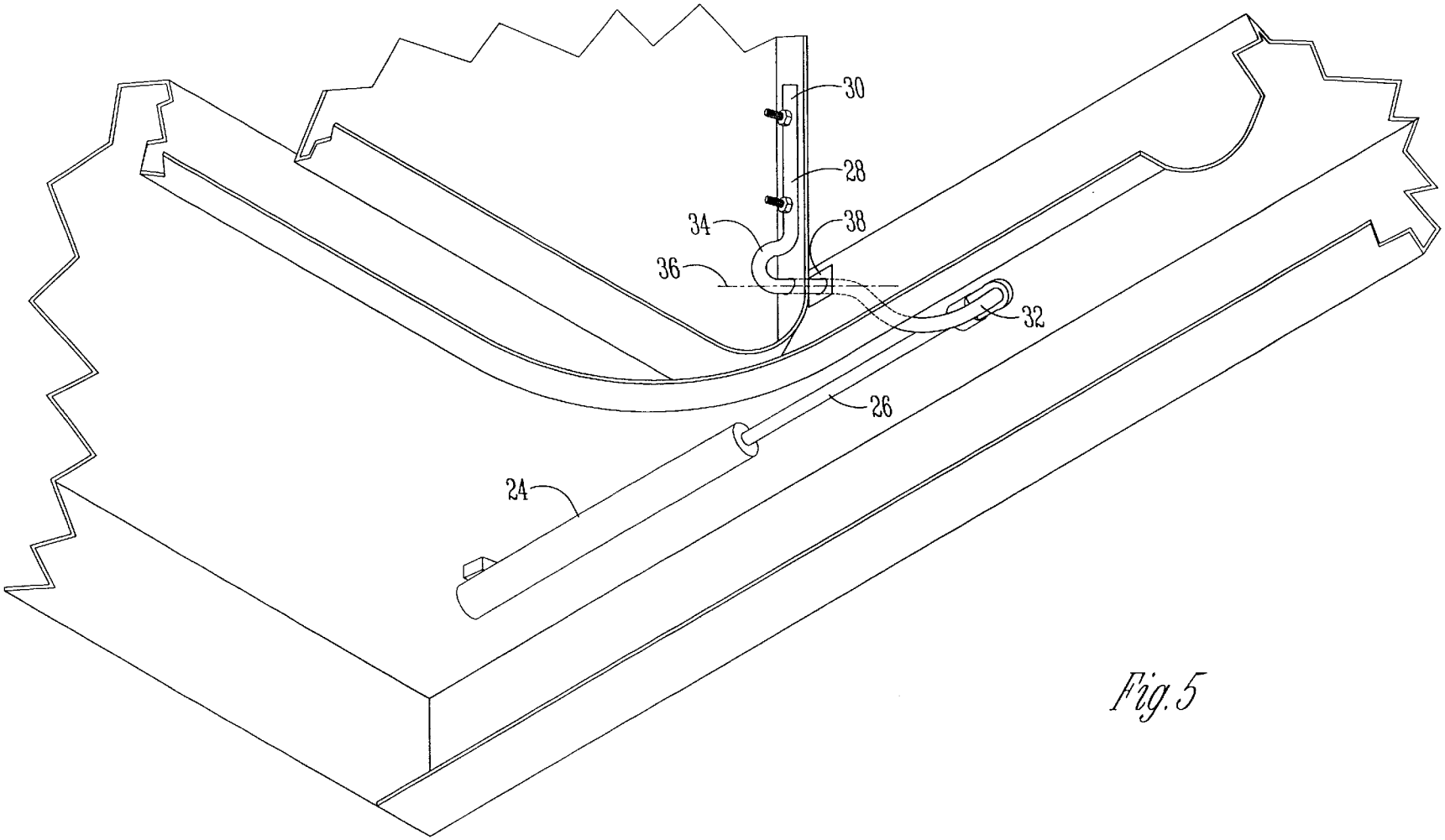
FIG. 5 is a partial perspective view showing the gas-discharge cylinder and lever arm of the present invention.

The appliance 10 also includes a gas-charged strut or cylinder 24 mounted within the cabinet. The cylinder includes an arm 26 which can be retracted, as shown in FIGS. 1 and 3, or extended, as shown in FIGS. 2, 4 and 5. As best seen in FIG. 5, a lever arm 28 has a first end 30 bolted or otherwise connected to the door 18 and a second end 32 secured to the terminal end of the cylinder arm 26. The lever arm 28 includes a bent portion 34 such that the ends 30, 32 of the lever arm 28 are disposed angularly with regard to one another. The bent portion 34 also defines a pivot axis 36 about which the second end 32 of the lever arm 28 pivots when the cylinder arm 26 is extended and retracted. As seen in FIG. 5, the lever arm 28 extends through the door 18 and a portion of the cabinet 12. A bushing 38 may be provided in the cabinet 12 to minimize friction between the lever arm 28 and the cabinet 12.

In use, the door 18 of the appliance 10 can be moved from the closed position to the open position by a person simply by pushing on the door 18 adjacent the latch 20. Such a pushing force releases the latch 20 such that the stud 21 is released from the receptacle 22. The gas in the cylinder 24 then extends the cylinder arm 26, which in turn pivots the lever arm 28 about the pivot axis 36, thereby automatically moving the door 18 to the open position in a controlled manner. Preferably, movement of the door 18 to the open position will take approximately two seconds. Since the cylinder 24 biases the door 18 to the open position, the door will not accidentally fall from the open position.

When the user wants to close the door, the door is grasped and pushed towards the closed position, thereby overcoming the biasing force of the cylinder 24 to retract the cylinder arm 26. The door 18 is pushed to the closed position, until the latch 20 closes with the stud 21 received in the receptacle 22.

It is understood that the door, cylinder and latch assembly of the present invention can be utilized on other appliances, in addition to the top-loading washing machine shown in the drawings. For example, the assembly can be used on a front-loading washing machine, dryer, dishwasher or oven wherein the door pivots downwardly about a horizontal axis from the closed position to the open position. In such an appliance, the cylinder 24 controls the downward movement of the door to the open position, and does not allow the door to fall freely to the open position.

The door, cylinder and latch assembly can also be used on other appliances, such as a refrigerator or front-loading washing machine wherein the door pivots about a vertical axis between the open and closed positions. In all of these appliances, regardless of which direction the door opens, a person can easily open the door even though both hands are full by simply pushing on the door so as to release the latch 20 such that the cylinder 24 automatically opens the door. If the door is not fully closed, the person will be alerted since the cylinder 24 will re-open the door, rather than leaving the door slightly ajar.

Thus, it can be seen that the present invention accomplishes at least all of the stated objectives.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An improved top-loading clothes washer or dryer appliance having a cabinet with an interior chamber, an upwardly facing access opening to provide access to the chamber, and a door pivotally connected to the cabinet for movement between a closed position covering the opening and an open position exposing the opening, the improvement comprising:

a cylinder mounted to the cabinet and having an extensible arm;

a lever arm having a first end connected to the door, a second end connected to the cylinder arm, and a portion defining a pivot axis between the first and second ends; and whereby extension of the cylinder arm moves the lever arm so as to move the door upwardly to the open position.

2. The improved appliance of claim 1 wherein the first and second ends of the lever arm are angularly disposed with respect to one another.

3. The improved appliance of claim 1 wherein the cylinder is a gas-charged strut.

4. The improved appliance of claim 1 wherein the cylinder normally biases the door to an open position.

5. The improved appliance of claim 1 further comprising a latch for retaining the door in the closed position.

6. The improved appliance of claim 5 wherein the latch is a push-push latch.

7. A method of opening a door on a top-loading clothes washer or dryer appliance comprising:

pushing on the door to release a latch normally holding the door in a closed position; and applying a biasing force to the door to automatically urge the door upwardly to an open position.

8. The method of claim 7 wherein the biasing force is applied by a gas-charged cylinder.

9. The method of claim 7 wherein the biasing force is applied from within the appliance.

* * * * *